United States Patent [19]

Aikioniemi

[11] Patent Number: 4,598,897

[45] Date of Patent: Jul. 8, 1986

[54] HYDRAULIC TENSIONING TOOL

[75] Inventor: Vilho Aikioniemi, Eskilstuna, Sweden

[73] Assignee: Aktiebolaget Bygg -och Transportekonomi (BT) Div. Nike Hydraulics, Eskilstuna, Sweden

[21] Appl. No.: 700,533

[22] Filed: Feb. 11, 1985

[30] Foreign Application Priority Data

Feb. 16, 1984 [SE] Sweden ..... 8400832

[51] Int. Cl.[4] ..... E21B 19/00

[52] U.S. Cl. ..... 254/29 A; 92/5 R

[58] Field of Search ..... 254/29 A, 105; 29/452; 92/5 R

[56] References Cited

U.S. PATENT DOCUMENTS

| | | | |
|---|---|---|---|
| 3,090,598 | 5/1963 | Paul | 254/29 A |
| 3,176,961 | 4/1965 | Glass | 254/29 A |
| 3,654,549 | 4/1972 | Maurer et al. | 92/5 R |
| 3,692,277 | 9/1972 | Schwartz et al. | 254/29 A |
| 3,956,973 | 5/1976 | Pomplas | 92/59 |
| 4,471,304 | 9/1984 | Wolf | 92/5 R |

*Primary Examiner*—Robert C. Watson

*Attorney, Agent, or Firm*—Frishauf, Holtz, Goodman & Woodward

[57] ABSTRACT

An hydraulic tensioning tool for tensioning reinforcing cables, rods or like devices in concrete structure. A first working piston-cylinder device (21) is arranged to effect the actual work of tensioning the cable, while a second working piston-cylinder device (22) causes the cable to be anchored to a cable lock (12). The first device (21) includes a tensioning cylinder (23) and a tensioning piston (24) having mounted on the outer free end (25) thereof a readily removed cable holder (14). The tensioning cylinder (23) of the first piston-cylinder device and the locking cylinder (27) of the second piston-cylinder device (22) are accommodated in a common cylinder housing (11), although separated by a partition (29) which forms the bottoms of respective cylinders, such that the tensioning piston (24) and the locking piston (26) for the cable lock (12) are movable in mutually opposite directions during their respective working strokes. An electromagnetic position indicator (16) is arranged between the cylinder housing and the cable holder for measuring the extent of movement therebetween and for stopping said movement when a given magnitude has been reached.

23 Claims, 6 Drawing Figures

HYDRAULIC TENSIONING TOOL

BACKGROUND OF THE INVENTION

The present invention relates to an hydraulic tensioning tool for tensioning reinforcing cables, rods and like devices in concrete structures, comprising a first working piston-cylinder device which includes a tensioning cable-holder, and a second working piston-cylinder device which includes a cable lock for anchoring the cable subsequent to tensioning the same.

Tools of the aforesaid kind are used for tensioning reinforcing cables and like devices in prestressed concrete beams and like structural components manufactured en mass in separate beam beds provided with devices for anchoring the cables at both ends thereof. Prior to setting of the concrete the cables are stretched to a given tension and extension and are held in the concrete mass until the concrete has solidified to firmly anchor the cables therein, whereafter the cables are severed close to the end surfaces of the beams. When tensioning the cables of respective concrete beds, the tensioning tool is moved manually from cable to cable, and since a beam often contains twenty or more such cables it will be seen that high demands are placed on the reliability of the tool and its ease of handling. The tools used today, however, are very unsatisfactory in several respects. For example, the cable holder is difficult to reach for cleaning or maintenance purposes and the presence of many movable components equipped with seals and packings etc. which are subjected to constant wear means that the tool must be serviced regularly at short intervals. Furthermore it is difficult to control and regulate extension of the cable, which is a serious drawback since when tensioning a cable in the present context it is necessary to control both the tensioning load applied thereto and the extension created therein.

Accordingly an object of the invention is to provide a tool of the aforesaid kind with which the disadvantages encountered with known tools are overcome, This object and further objects will be apparent from the following description of the invention, from which the advantages afforded by the invention will also be understood.

BRIEF DESCRIPTION OF THE DRAWINGS

The invention will now be described in more detail with reference to the accompanying drawings, in which.

DETAILED DESCRIPTION

Figure 1:
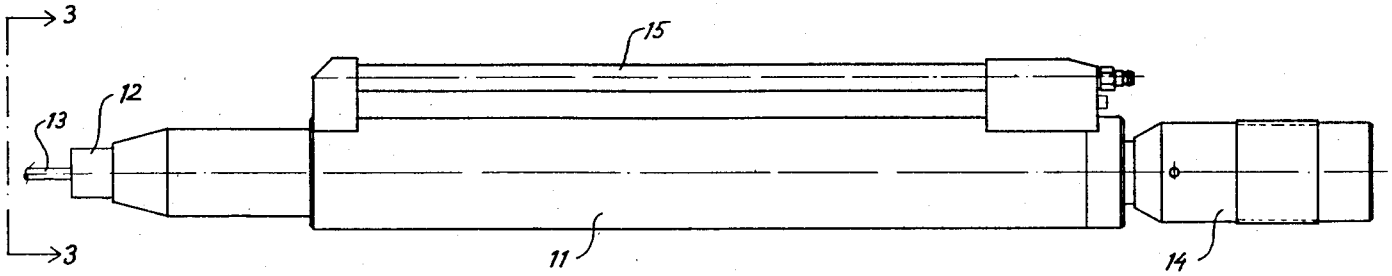
FIG. 1 is a side view of a tensioning tool according to the invention.
Figure 2:
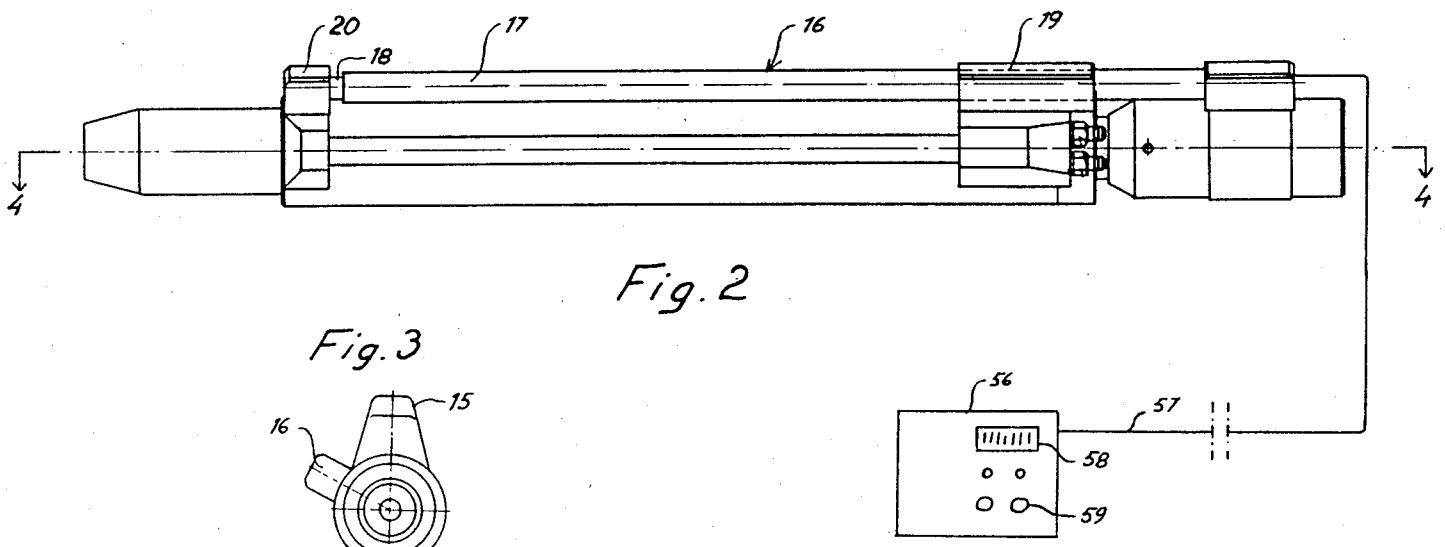
FIG. 2 is a top view of the tool.
Figure 3:
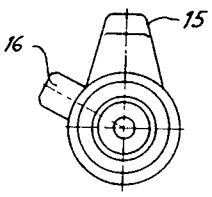
FIG. 3 is a front view seen in the direction of arrows 3 in FIG. 1.

The tensioning tool includes a cylinder housing 11 having arranged at its forward end a cable lock 12 intended for anchoring a cable 13 on a suitable anvil or counter-pressure surface. Extending from the rearward end of the housing 11 is a cable holder 14 intended for engagement with the cable 13 as the cable is tensioned. The tool is handled manually with the aid of a carrying handle 15 mounted on the cylinder housing 11. The requisite hydraulic lines are accommodated in the handle. An electromechanical position indicator 16 of suitable design is mounted between the cylinder housing and the cable holder 14 for measuring the relative movement therebetween. The position indicator 16 is of the kind comprising a coil assembly 17 and a core 18, the coil assembly 17 being attached to the cable holder 14 and extending through a support bearing 19 mounted on the cylinder housing, which also carries the core attachment 20. The coil 17 is arranged to generate in a known manner a magnetic flux which is influenced by the extent to which the core enters the coil assembly.

The cylinder housing 11 accommodates a first working piston-cylinder device 21 for working the cable holder 14, and a second working piston-cylinder-device 22 for activating the cable lock 12. The first working piston-cylinder-device 21 comprises a tension cylinder 23 and a tensioning piston 24 arranged for movement therein, the cable holder 14 being mounted on the end 25 of the piston projecting from the cylinder housing. The second working piston-cylinder-device 22 includes a locking piston 26 which is movable in a locking cylinder 27 against the action of a coil spring 28 arranged in the cylinder. The two working devices 21,22 are mutually separated by a common partition 29 which forms a bottom surface for respective cylinders and also incorporates channels 30,31 for the supply of hydraulic fluid. The cable 13, which extends through the centre of the cylinder housing, is encased by a guide tube 32, which is firmly anchored to the partition 29 through a pin 33 and a lock plate 34. Arranged in the tube 32 is a longitudinally extending groove 35 in which a guide key 36 mounted on the tensioning piston 24 is arranged to run, thereby to prevent the piston from rotating around the guide tube.

The cable holder includes a cylindrical sleeve 40 which is screwed firmly onto the outer piston-end 25. The sleeve has arranged therein a plurality of wedge-shaped jaws 41 which are intended to encircle the cable 13 and to be cammed into abutment therewith by a conical surface on the inside of the sleeve. The jaws 41 are held pressed against the conical surface 42 with the air of a coil spring 43 mounted between the jaws and a backpiece 44 on the sleeve. The backpiece is secured to the sleeve with the aid of a suitable coupling, e.g. a locking ring, so as to enable the backpiece to be readily removed so as to render the jaws 41 accessible for cleaning and replacement. The forward end of the sleeve has provided therein, forwardly of the jaws, a plurality of radially disposed holes 47 through which a flushing medium can be supplied to effect a quick clean of the tool with the sleeve in place. These holes also provide means for attaching a screw tool for dismantling the sleeve.

Figure 6:
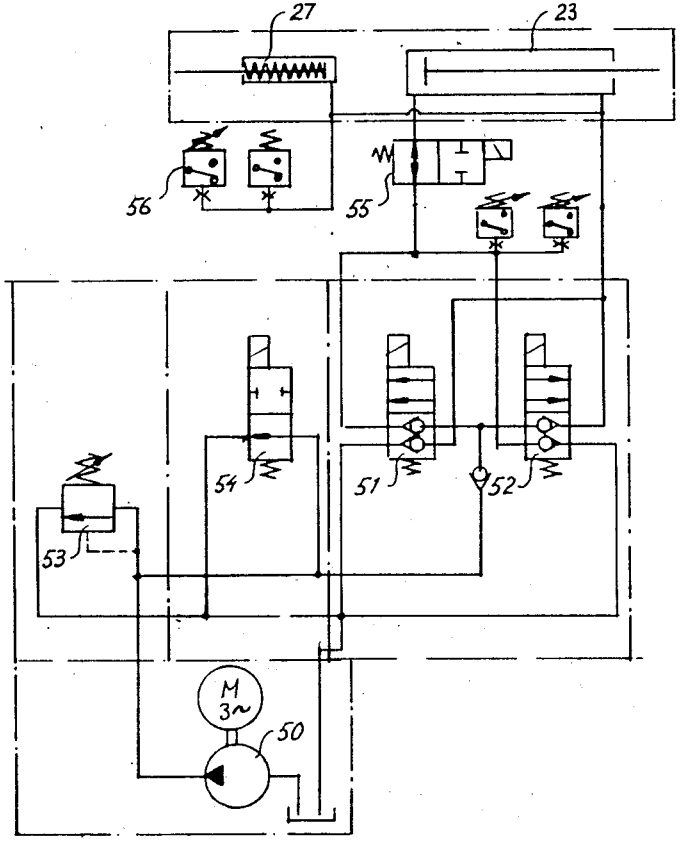
FIG. 6 illustrates schematically a hydraulic system for operating the tool.
Figure 5:
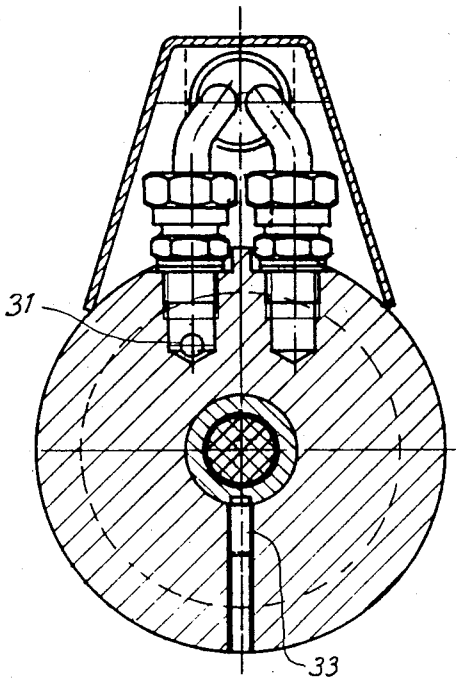
FIG. 5 is a cross-sectional view taken on the line 5—5 in FIG. 4.

FIG. 6 illustrates schematically the hydraulic system of the tensioning tool. A motor driven pump 50 feeds hydraulic fluid to an off-load valve 54, to enable the tool to be operated in an idling mode. A pressure-limit valve 53 is connected between the pump 50 and its hydraulic-fluid tank or reservoir, and a first and second auxiliary valve 51,52 between the pump 50 and the tensioning cylinder 23. A third auxiliary valve 55 is coupled between the first auxiliary valve 51 and the cylinder 23. A series of electric transducers 56 mark that the tensioning tool is arranged for electrical resistance operation.

The tensioning tool is controlled from a separately arranged operating panel 56 which is connected with the position indicator 16 through a line 57 and also with a further line (not shown) present in the hydraulic circuit and incorporating a pressure indicator. The operating panel includes instruments 58 for indicating the length of stroke of the tensioning piston and the hydraulic pressure, i.e. the load, and also control means 59 for manually or automatically activating the valves in the hydraulic circuit.

Figure 4:
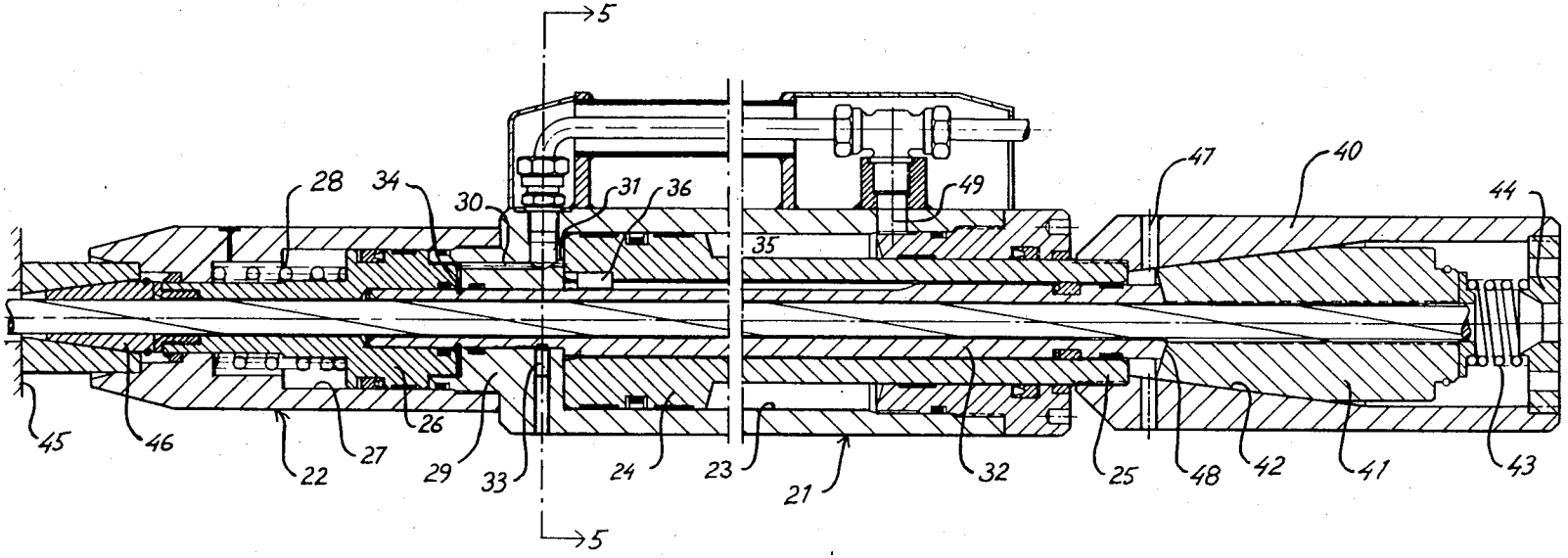
FIG. 4 is a cross-sectinal view taken on the line 4—4 in FIG. 2.

When a cable is to be stretched and tensioned with the aid of the tool, the cable is first passed straight through the tool and then brought into abutment with an anvil 45 or the like counter-pressure surface. In this starting position, illustrated in FIG. 4, both the locking piston 26 and the tensioning piston 24 are located in their bottom positions. When tensioning is to commence, the settings of the off-load valve 54 and the first auxiliary valve 51 are changed from those illustrated in FIG. 6 and hydraulic fluid is passed through the third auxiliary valve 55 to the tensioning cylinder 23. The hydraulic fluid is pressed through the channel 31 and the piston 24 begins to extend. As a result of the wedging effect between the sleeve 40 and the jaws 41, the jaws are cammed firmly against the cable and lock the same fast. Tensioning of the cable continues until a given tension is reached and a given distance has been measured by the electromechanical position indicator 16. The valve 51 is activated herewith and returns to its closed position and the valve 55 is re-set to its closed, locking position. The auxiliary valve 52 is now opened in order to activate the locking cylinder 27, and hydraulic fluid is passed into the cylinder 27 through the channel 30. Since a part of the guide tube 32 projects into the locking piston, it is possible to seal the piston effectively against the centrally located cable lead-through. The piston firmly pressed the inner wedges 46 in the wedge lock 12 in a conventional manner, whereafter the double-acting tensioning cylinder 23 passes hydraulic fluid through the channel 49 in the cylinder housing via the re-opened valve 55, so as to withdraw the piston to its bottom position. The whole of the cylinder housing is moved in this way towards the cable holder 14 while the cable lock 12 leaves its seat in the locking cylinder and remains at the anvil 45. The guide tube 32 is given a length such that the rearward end 48 thereof projecting from the tensioning piston strikes against the jaws 41 before the piston has reached its bottom position, thereby to move the jaws out of engagement with the cable. A tensioning operation is normally completed with one stroke of the piston, and hence the tool can now be moved to the next cable to be tensioned. If a further working piston stroke is required, however, the tool is again moved towards the cable lock and the aforesaid procedure repeated.

As beforementioned, a tensioning operation is controlled from the control panel 56 with the aid of indications given by a pressure transducer in the hydraulic circuit and from the position indicator 16. The length of stroke of the tensioning piston and the tensioning force or load applied can be readily read-off from the instruments 58, to determine exactly the extent to which the cable is stretched at a given load. Although not shown, the control means 59 include switch means for zero-setting and automatic restriction of the length of piston stroke and for automatically switching-off when the maximum permitted hydraulic pressure has been reached. Before tensioning can be accepted, it is necessary for both the load and the cable-extension to reached prescribed values. If, for exmple, the load reaches its prescribed value before or after the cable has been extended to the prescribed extent, the cable cannot be accepted, which is also true of course in those cases where the prescribed load is never reached. Accepted values with respect to load and extension are suitably indicated by the illumination of indicating lamps, wherewith both the load lamp and the extension lamp must be illuminated in order for the cable to be accepted.

The tensioning tool according to the invention affords important advantages with respect to the operator, since subsequent to commencing a tensioning operation all that he is required to do is to read indicating lamps or other instruments, in order to establish that the cable has been tensioned in an acceptable fashion. Thus, it is not necessary to take readings manually directly on the tool, or to take measurements with a tape measure or like device. In addition hereto, the safety of the operator is improved through the remote control arrangement and the automatic system which always stops the tensioning operation, even when the prescribed values are not attained. It is impossible, for example, for a cable to snap.

Finally, the tensioning device is easy to handle and service, as previously mentioned. This has been achieved by causing the working piston-cylinder devices to operate in different directions in a common cylinder housing, thereby enabling the supply of hydraulic fluid, seals etc. to be arranged in a favourable manner. The cable holder can also be easily reached for cleaning purposes and any repairs which might be needed, which is extremely important in the case of tools such as these, which are used in a very troublesome environment. For example, the cable is often both rusty and otherwise contaminated, which would create a great deal of wear on the jaws if it were not possible to blow them clean with compressed air, or to remove them for cleaning at regular intervals.

It will be understood that the invention is not restricted to the described and illustrated embodiment, and that modifications can be made within the scope of the following claims.

I claim:

1. An hydraulic tensioning tool for tensioning reinforcing cables, rods and like devices (13) in concrete structures, comprising:

a first working piston-cylinder device (21) including a cylinder (23) and a tensioning piston (24); and a cable holder (14) for creating tension; and a second working piston-cylinder device (12) including a locking cylinder (27) and a locking piston (26); and a cable lock (12) for anchoring the cable subsequent to creating tension therein;

a cylinder housing (11) in which both of said piston-cylinder devices (21,12) are housed, said cylinder housing (11) being common to both of said piston-cylinder devices;

said piston (24,26) of said first and second piston-cylinder devices being movable in mutually opposite directions during their respective working strokes;

said tensioning piston (24) having a free end (25) projecting from said cylinder housing, and said cable holder (14) being mounted on said free projecting end (25); and an electromechanical position indicator (16) arranged between said cylinder housing (11) and said cable holder (14);

said position indicator (16) including a coil assembly (17) for generating a magnetic flux, and a core (18) arranged for insertion into said coil assembly so as to influence the magnetic flux in relation to the relative movement between said cylinder housing (11) and said cable holder (14);

said cable holder (14) including an outer sleeve (40) having movable tensioning jaws (41) mounted therein; and said outer sleeve (40) including a readily removable backpiece (44).

2. The tool of claim 1, wherein said coil assembly (17) is attached to said outer sleeve (40), and said core (18) is attached to said cylinder housing (11).

3. The tool of claim 1, wherein said coil assembly (17) is attached to said cylinder housing (11), and said core (18) is attached to said sleeve (40).

4. The tool of claim 1, wherein said sleeve (40) has a forward end, and through-passing holes (47) disposed radially in said forward end thereof for connection to a source of pressurized flushing medium.

5. The tool of claim 1, comprising guide means (59) coupled to said position indicator (16) for automatically stopping mutual movement between said cylinder housing (11) and said cable holder (14) when said movement reaches a given magnitude.

6. The tool of claim 1, wherein said housing (11) has a partition (29) which is common to said tensioning cylinder (23) and said locking cylinder respectively, opposite sides of said common partition (29) forming bottoms of said tensioning and locking cylinders; and said partition (24) has channels (30,31) formed therein for supplying hydraulic fluid to said first and second piston-cylinder devices (21,12).

7. The tool of claim 1, comprising a guide tube (32) arranged centrally in said cylinder housing to prevent relative movement between said tensioning piston (24) and said cylinder housing.

8. The tool of claim 7, wherein said guide tube (32) has a length such that the outer end of the guide tube (32) projects into said cable holder (14) and moves said tensioning jaws (41) away from said cable or like devices when said tensioning piston (24) occupies an inserted bottom position in said tensioning cylinder (23).

9. An hydraulic tensioning tool for tensioning reinforcing cables, rods and like devices (13) in concrete structures, comprising:

a first working piston-cylinder device (21) including a cylinder (23) and a tensioning piston (24); and a cable holder (14) for creating tension; and a second working piston-cylinder device (12) including a locking cylinder (27) and a locking piston (26); and a cable lock (12) for anchoring the cable subsequent to creating tension therein;

a cylinder housing (11) in which both of said piston-cylinder devices (21,12) are housed, said cylinder housing (11) being common to both of said piston-cyinder devices;

said piston (24,26) of said first and second piston-cylinder devices being movable in mutually opposite directions during their respective working strokes;

said tensioning piston (24) having a free end (25) projecting from said cylinder housing, and said cable holder (14) being mounted on said free projecting end (25); and an electromechanical position indicator (16) arranged between said cylinder housing (11) and said cable holder (14);

said position indicator (16) including a coil assembly (17) for generating a magnetic flux, and a core (18) arranged for insertion into said coil assembly so as to influence the magnetic flux in relation to the relative movement between said cylinder housing (11) and said cable holder (14);

said cable holder (14) including an outer sleeve (40) having movable tensioning jaws (41) mounted therein;

said sleeve (40) having a forward end, and through-passing holes (47) disposed radially in said forward end thereof for connection to a source of pressurized flushing medium.

10. The tool of claim 9, wherein said coil assembly (17) is attached to said outer sleeve (40), and said core (18) is attached to said cylinder housing (11).

11. The tool of claim 9, wherein said coil assembly (17) is attached to said cylinder housing (11), and said core (18) is attached to said sleeve (40).

12. The tool of claim 9, comprising guide means (59) coupled to said position indicator (16) for automatically stopping manual movement between said cylinder housing (11) and said cable holder (14) when said movement reaches a given magnitude.

13. The tool of claim 9, wherein said housing (11) has a partition (29) which is common to said tensioning cylinder (23) and said locking cylinder respectively, opposite sides of said common partition (29) forming bottoms of said tensioning and locking cylinders; and said partition (24) has channels (30,31) formed therein for supplying hydraulic fluid to said first and second piston-cylinder devices (21,12).

14. The tool of claim 9, comprising a guide tube (32) arranged centrally in said cylinder housing to prevent relative movement between said tensioning piston (24) and said cylinder housing.

15. The tool of claim 14, wherein said guide tube (32) has a length such that the outer end of the guide tube (32) projects into said cable holder (14) and moves said tensioning jaws (41) away from said cable or like device when said tensioning piston (24) occupies an inserted bottom position in said tensioning cylinder (23).

16. An hydraulic tensioning tool for tensioning reinforcing cables, rods and like devices (13) in concrete structures, comprising:

a first working piston-cylinder device (21) including a cylinder (23) and a tensioning piston (24); and a cable holder (14) for creating tension; and a second working piston-cylinder device (12) including a locking cylinder (27) and a locking piston (26); and a cable locking (12) for anchoring the cable subsequent to creating tension therein;

a cylinder housing (11) in which both of said piston-cylinder devices (21,12) are housed, said cylinder housing (11) being common to both of said piston-cylinder devices;

said piston (24,26) of said first and second piston-cylinder devices being movable in mutually opposite directions during this respective working strokes;

said tensioning piston (24) having a free end (25) projecting from said cylinder housing, and said cable holder (14) being mounted on said free projecting end (25); and an electromechanical position indicator (16) arranged between said cylinder housing (11) and said cable holder (14);

said position indicator (16) including a coil assembly (17) for generating a magnetic flux, and a core (18) arranged for insertion into said coil assembly so as to influence the magnetic flux in relation to the relative movement between said cylinder housing (11) and said cable holder (14);

said housing (11) having a partition (29) which is common to said tensioning cylinder (23) and said locking cylinder respectively, opposite sides of said common partition (29) forming bottoms of said tensioning and locking cylinders; and said partition (29) having channels (30,31) formed therein for supplying hydraulic fluid to said first and second piston-cylinder devices (21,12).

17. The tool of claim 16, wherein said cable holder (14) includes an outer sleeve (40) having movable tensioning jaws (41) mounted therein.

18. The tool of claim 16, wherein said coil assembly (17) is attached to said outer sleeve (40), and said core (18) is attached to said cylinder housing (11).

19. The tool of claim 16, wherein said coil assembly (17) is attached to said cylinder housing (11), and said core (18) is attached to said sleeve (40).

20. The tool of claim 16, comprising guide means (59) coupled to said position indicator (16) for automatically stopping mutual movement between said cylinder housing (11) and said cable holder (14) when said movement reaches a given magnitude.

21. The tool of claim 16, comprising a guide tube (32) arranged centrally in said cylinder housing to prevent relative movement between said tensioning piston (24) and said cylinder housing.

22. The tool of claim 17, comprising a guide tube (32) arranged centrally in said cylinder housing to prevent relative movement between said tensioning piston (24) and said cylinder housing.

23. The tool of claim 22, wherein said guide tube (32) has a length such that the outer end of the guide tube (32) projects into said cable holder (14) and moves said tensioning jaws (41) away from said cable or like device when said tensioning piston (24) occupies an inserted bottom position in said tensioning cylinder (23).

* * * * *